US010370999B2

(12) United States Patent
Blaney et al.

(10) Patent No.: US 10,370,999 B2
(45) Date of Patent: Aug. 6, 2019

(54) GAS TURBINE ENGINE RAPID RESPONSE CLEARANCE CONTROL SYSTEM WITH AIR SEAL SEGMENT INTERFACE

(71) Applicant: United Technologies Corporation, Hartford, CT (US)

(72) Inventors: Ken F. Blaney, Middleton, NH (US); Paul M. Lutjen, Kennebunkport, ME (US); Brian R. Pelletier, Berwick, ME (US)

(73) Assignee: United Technologies Corporation, Farmington, CT (US)

( * ) Notice: Subject to any disclaimer, the term of this patent is extended or adjusted under 35 U.S.C. 154(b) by 849 days.

(21) Appl. No.: 14/780,838

(22) PCT Filed: Feb. 6, 2014

(86) PCT No.: PCT/US2014/015063

§ 371 (c)(1),
(2) Date: Sep. 28, 2015

(87) PCT Pub. No.: WO2014/200575

PCT Pub. Date: Dec. 18, 2014

(65) Prior Publication Data

US 2016/0053626 A1 Feb. 25, 2016

Related U.S. Application Data

(60) Provisional application No. 61/811,546, filed on Apr. 12, 2013.

(51) Int. Cl.

| | |
|---|---|
| ***F01D 11/22*** | (2006.01) |
| ***F01D 11/20*** | (2006.01) |
| ***F04D 29/16*** | (2006.01) |
| ***F04D 29/52*** | (2006.01) |

(52) U.S. Cl.

CPC ..... *F01D 11/20* (2013.01); *F01D 11/22* (2013.01); *F04D 29/164* (2013.01); *F04D 29/526* (2013.01)

(58) Field of Classification Search

CPC ..... F01D 11/20; F01D 11/22; F01D 11/08
See application file for complete search history.

(56) References Cited

U.S. PATENT DOCUMENTS

| | | | |
|---|---|---|---|
| 4,127,357 | A | 11/1978 | Patterson |
| 4,131,388 | A | 12/1978 | Brodell |
| 5,049,033 | A | 9/1991 | Corsmeier et al. |
| 5,054,997 | A | 10/1991 | Corsmeier et al. |
| 5,096,375 | A | 3/1992 | Ciokailo |
| 5,601,402 | A | 2/1997 | Wakeman et al. |
| 2003/0185674 | A1 | 10/2003 | Alford et al. |
| 2010/0215477 | A1 | 8/2010 | Wilson |
| 2010/0313404 | A1 | 12/2010 | Bates |

FOREIGN PATENT DOCUMENTS

| | | |
|---|---|---|
| DE | 1291560 | 3/1969 |
| JP | S62142808 | 6/1987 |

OTHER PUBLICATIONS

Extended EP Search Report dated Mar. 24, 2016.

*Primary Examiner* — Richard A Edgar
*Assistant Examiner* — Michael L Sehn
(74) *Attorney, Agent, or Firm* — O'Shea Getz P.C.

(57) ABSTRACT

An active clearance control system of a gas turbine engine includes an air seal segment with a bridge hook having a lugged aperture.

17 Claims, 8 Drawing Sheets

GAS TURBINE ENGINE RAPID RESPONSE CLEARANCE CONTROL SYSTEM WITH AIR SEAL SEGMENT INTERFACE

This application claims priority to PCT Patent Application No. PCT/US14/15063 filed Feb. 6, 2014, which claims priority to U.S. Patent Appln. No. 61/811,546 filed Apr. 12, 2013.

STATEMENT REGARDING FEDERALLY SPONSORED RESEARCH OR DEVELOPMENT

This disclosure was made with Government support under FA-8650-09-D-2923 0021 awarded by The United States Air Force. The Government has certain rights in this disclosure.

BACKGROUND

The present disclosure relates to a gas turbine engine and, more particularly, to a blade tip rapid response active clearance control (RRACC) system therefor.

Gas turbine engines, such as those that power modern commercial and military aircraft, generally include a compressor to pressurize an airflow, a combustor to burn a hydrocarbon fuel in the presence of the pressurized air, and a turbine to extract energy from the resultant combustion gases. The compressor and turbine sections include rotatable blade and stationary vane arrays. Within an engine case structure, the radial outermost tips of each blade array are positioned in close proximity to a shroud assembly. Blade Outer Air Seals (BOAS) supported by the shroud assembly are located adjacent to the blade tips such that a radial tip clearance is defined therebetween.

When in operation, the engine thermal environment varies such that the radial tip clearance varies. The radial tip clearance is typically designed so that the blade tips do not rub against the BOAS under high power operations when the blade disk and blades expand as a result of thermal expansion and centrifugal loads. When engine power is reduced, the radial tip clearance increases. To facilitate engine performance, it is operationally advantageous to maintain a close radial tip clearance through the various engine operational conditions.

SUMMARY

An active clearance control system for a gas turbine engine according to one disclosed non-limiting embodiment of the present disclosure includes an air seal segment with a lugged aperture.

A further embodiment of the present disclosure includes a bridge hook that includes said lugged aperture.

A further embodiment of any of the foregoing embodiments of the present disclosure includes a forward hook and an aft hook that extends from said air seal segment, said bridge hook between said forward hook and said aft hook.

A further embodiment of any of the foregoing embodiments of the present disclosure includes, wherein said lugged aperture includes three (3) lug apertures.

A further embodiment of any of the foregoing embodiments of the present disclosure includes, wherein said lugged aperture includes a transverse split through said lugged aperture.

A further embodiment of any of the foregoing embodiments of the present disclosure includes a puller with a multiple of lugs engageable with said lugged aperture.

A further embodiment of any of the foregoing embodiments of the present disclosure includes, wherein said multiple of lugs each define a lug engagement surface engageable with an aperture engagement surface of said lugged aperture.

A further embodiment of any of the foregoing embodiments of the present disclosure includes, wherein said lug engagement surface defines a semi-spherical profile.

A further embodiment of any of the foregoing embodiments of the present disclosure includes, wherein said aperture engagement surface defines a frustro-conical profile.

A further embodiment of any of the foregoing embodiments of the present disclosure includes, wherein said aperture engagement surface defines a frustro-conical profile.

A further embodiment of any of the foregoing embodiments of the present disclosure includes a chamfer on an insertion surface of said multiple of lugs and a chamfer on said lugged aperture opposite said aperture engagement surface.

An active clearance control system of a gas turbine engine according to one disclosed non-limiting embodiment of the present disclosure includes an air seal segment with a bridge hook having a lugged aperture; and a puller with a multiple of lugs engageable with said lugged aperture.

A further embodiment of any of the foregoing embodiments of the present disclosure includes a forward hook and an aft hook that extends from said air seal segment, said bridge hook between said forward hook and said aft hook.

A further embodiment of any of the foregoing embodiments of the present disclosure includes, wherein said lugged aperture includes three (3) lug apertures.

A method of active blade tip clearance control for a gas turbine engine, according to one disclosed non-limiting embodiment of the present disclosure includes engaging a puller with an air seal segment through a lugged contact interface.

A further embodiment of any of the foregoing embodiments of the present disclosure includes, wherein the lugged contact interface includes a spherical interface.

A further embodiment of any of the foregoing embodiments of the present disclosure includes, wherein the lugged contact interface includes a frustro-conical interface.

A further embodiment of any of the foregoing embodiments of the present disclosure includes, wherein the lugged contact interface is a spherical to conical interface.

A further embodiment of any of the foregoing embodiments of the present disclosure includes, inserting a multiple of lugs that extend from the puller into a lugged aperture; and rotating the puller to obtain the lugged contact interface.

A further embodiment of any of the foregoing embodiments of the present disclosure includes rotationally fixing the puller at the lugged contact interface.

The foregoing features and elements may be combined in various combinations without exclusivity, unless expressly indicated otherwise. These features and elements as well as the operation thereof will become more apparent in light of the following description and the accompanying drawings. It should be understood, however, the following description and drawings are intended to be exemplary in nature and non-limiting.

BRIEF DESCRIPTION OF THE DRAWINGS

Various features will become apparent to those skilled in the art from the following detailed description of the disclosed non-limiting embodiment. The drawings that accompany the detailed description can be briefly described as follows.

DETAILED DESCRIPTION

Figure 1:
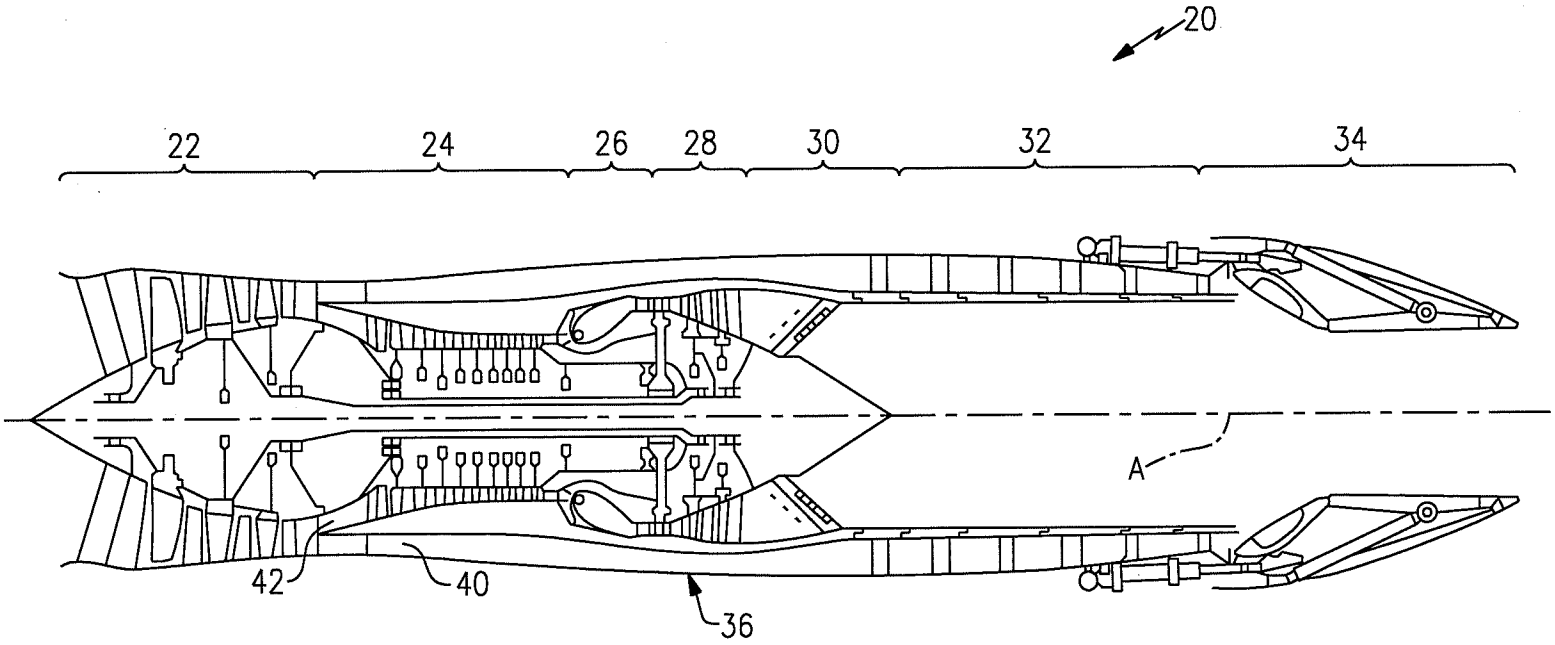
FIG. 1 is a schematic cross-section of one example aero gas turbine engine.

FIG. 1 schematically illustrates a gas turbine engine 20. The gas turbine engine 20 is disclosed herein as a two-spool low-bypass augmented turbofan that generally incorporates a fan section 22, a compressor section 24, a combustor section 26, a turbine section 28, an augmenter section 30, an exhaust duct section 32, and a nozzle system 34 along a central longitudinal engine axis A. Although depicted as an augmented low bypass turbofan in the disclosed non-limiting embodiment, it should be understood that the concepts described herein are applicable to other gas turbine engines including non-augmented engines, geared architecture engines, direct drive turbofans, turbojet, turboshaft, multi-stream variable cycle adaptive engines and other engine architectures. Variable cycle gas turbine engines power aircraft over a range of operating conditions and essentially alters a bypass ratio during flight to achieve countervailing objectives such as high specific thrust for high-energy maneuvers yet optimizes fuel efficiency for cruise and loiter operational modes.

An engine case structure 36 defines a generally annular secondary airflow path 40 around a core airflow path 42. Various case structures and modules may define the engine case structure 36 which essentially defines an exoskeleton to support the rotational hardware.

Air that enters the fan section 22 is divided between a core airflow through the core airflow path 42 and a secondary airflow through a secondary airflow path 40. The core airflow passes through the combustor section 26, the turbine section 28, then the augmentor section 30 where fuel may be selectively injected and burned to generate additional thrust through the nozzle system 34. It should be appreciated that additional airflow streams such as third stream airflow typical of variable cycle engine architectures may additionally be sourced from the fan section 22.

The secondary airflow may be utilized for a multiple of purposes to include, for example, cooling and pressurization. The secondary airflow as defined herein may be any airflow different from the core airflow. The secondary airflow may ultimately be at least partially injected into the core airflow path 42 adjacent to the exhaust duct section 32 and the nozzle system 34.

The exhaust duct section 32 may be circular in cross-section as typical of an axisymmetric augmented low bypass turbofan or may be non-axisymmetric in cross-section to include, but not be limited to, a serpentine shape to block direct view to the turbine section 28. In addition to the various cross-sections and the various longitudinal shapes, the exhaust duct section 32 may terminate in a Convergent/Divergent (C/D) nozzle system, a non-axisymmetric two-dimensional (2D) C/D vectorable nozzle system, a flattened slot nozzle of high aspect ratio or other nozzle arrangement.

Figure 2:
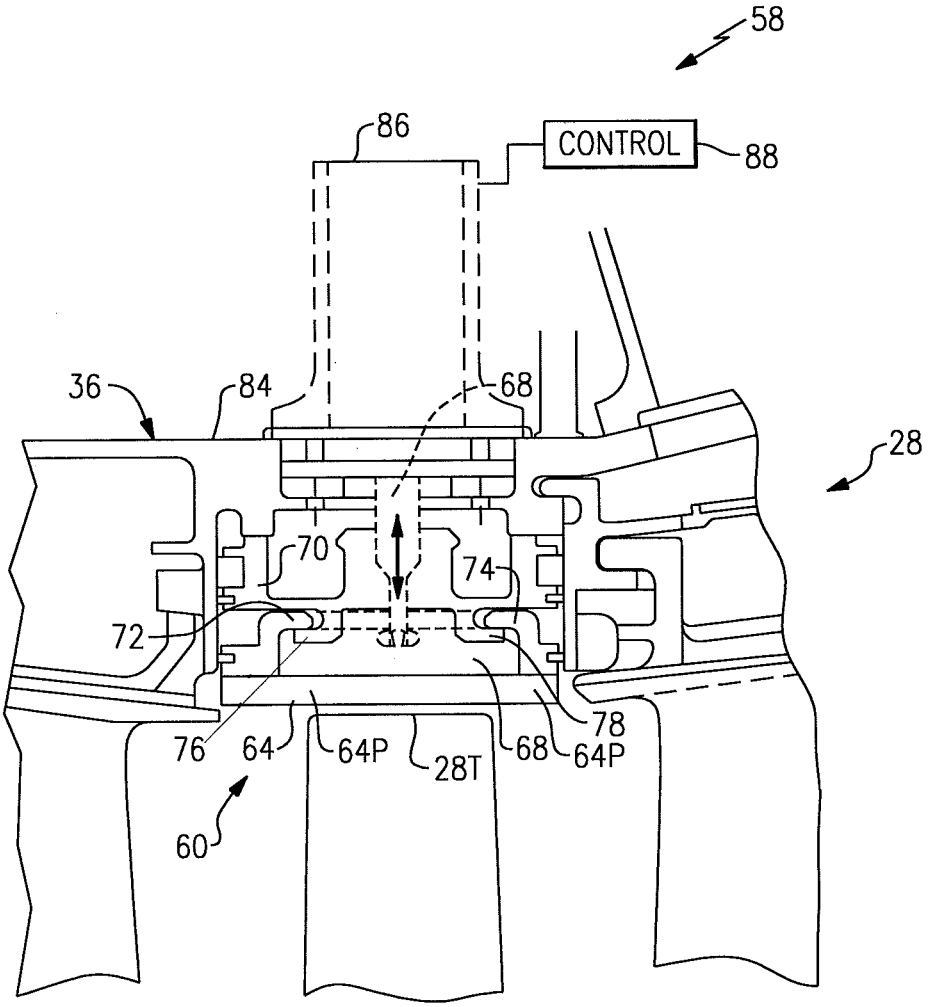
FIG. 2 is an is an enlarged partial sectional schematic view of a portion of a rapid response active clearance control system according to one disclosed non-limiting embodiment.

With reference to FIG. 2, a blade tip rapid response active clearance control (RRACC) system 58 includes a radially adjustable BOAS system 60 that operates to control blade tip clearances inside for example, the turbine section 28, however, other sections such as the compressor section 24 may also benefit herefrom. The radially adjustable BOAS system 60 may be arranged around each or particular stages within the gas turbine engine 20. That is, each rotor stage may have an associated radially adjustable BOAS system 60 of the blade tip RRACC system 58.

Figure 3:
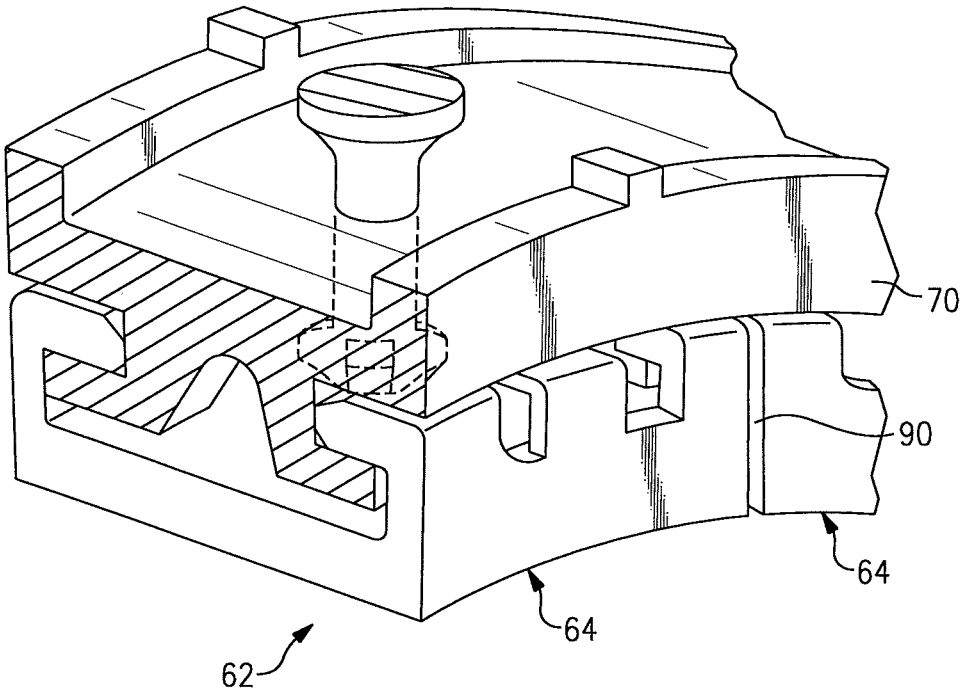
FIG. 3 is an enlarged perspective view of a circumferential portion of the rapid response active clearance control system with two air seal segments.

The radially adjustable BOAS system 60 is subdivided into a multiple of circumferential segments 62, each with a respective air seal segment 64 (also shown in FIG. 3) and a puller 68. In one disclosed non-limiting embodiment, each circumferential segment 62 may extend circumferentially for about nine (9) degrees and includes an associated puller 68. It should be appreciated that any number of circumferential segments 62 may be utilized and various other components may alternatively or additionally be provided.

Each of the multiple of air seal segments 64 is at least partially supported by a generally fixed full-hoop mount ring 70. That is, the full-hoop mount ring 70 is mounted to, or forms a portion of, the engine case structure 36. It should be appreciated that various static structures may additionally or alternatively be provided to at least partially support the multiple of air seal segments 64 yet permit relative radial movement therebetween.

Each air seal segment 64 may be manufactured of an abradable material to accommodate potential interaction with the rotating blade tips 28T within the turbine section 28 and includes numerous cooling air passages 64P to permit secondary airflow therethrough.

A forward hook 72 and a hook 74 of each air seal segment 64 respectively cooperates with a forward hook 76 and an aft hook 78 of the full-hoop mount ring 70. The forward hook 76 and the aft hook 78 of the full-hoop mount ring 70 may be segmented (FIG. 3) or otherwise configured for assembly of the respective air seal segment 64 thereto. The forward hook 72 may extend axially aft and the aft hook 74 may extend axially forward (shown); vice-versa or both may extend axially forward or aft within the engine to engage the reciprocally directed the forward hook 76 and the aft hook 78 of the full-hoop mount ring 70.

Figure 4:
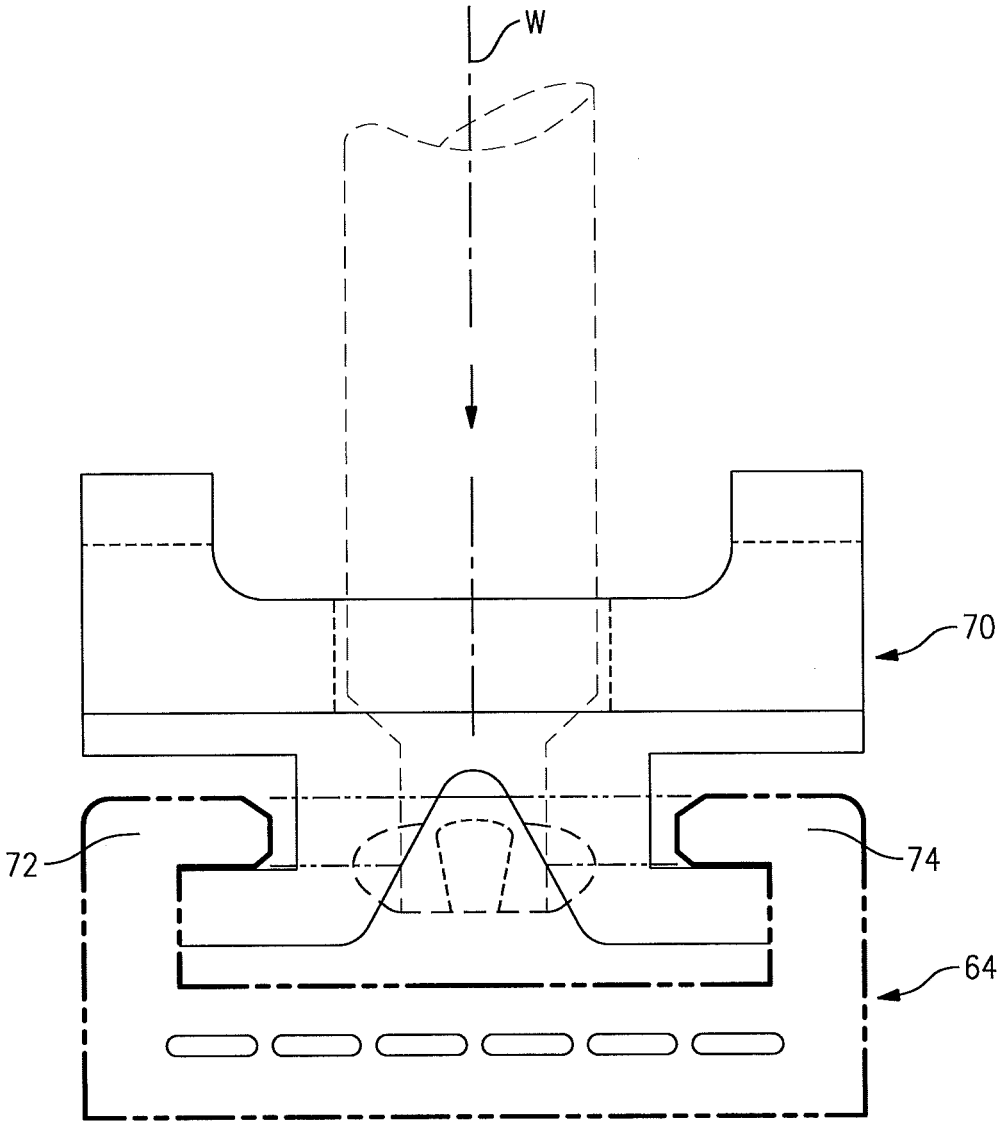
FIG. 4 is an enlarged partial sectional schematic view of one of a multiple of air seal segments with the rapid response active clearance control system in an extended radially contracted BOAS position.
Figure 5:
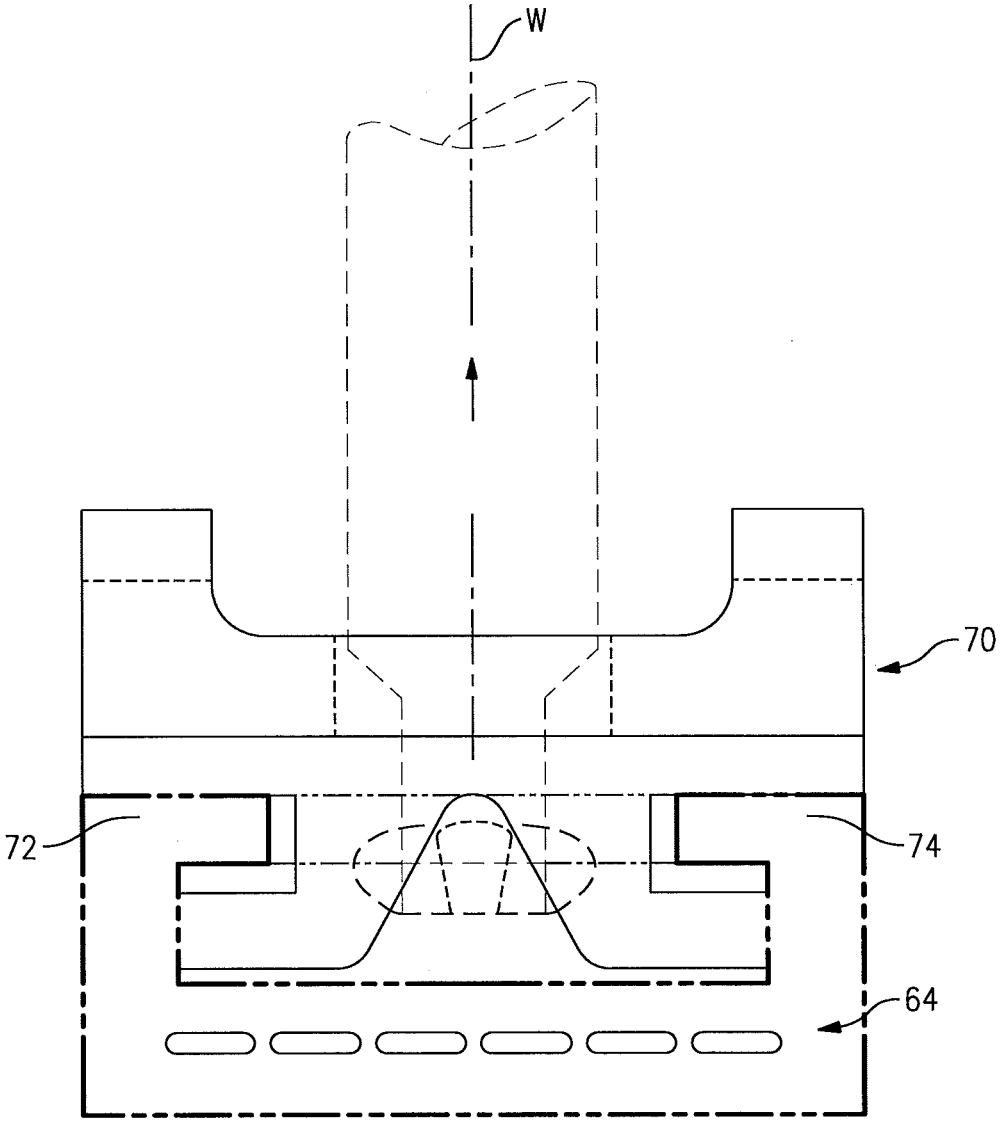
FIG. 5 is an enlarged partial sectional schematic view of one of a multiple of air seal segments with the rapid response active clearance control system in a retracted radially expanded BOAS position.

With continued reference to FIG. 2, each air seal segment 64 is radially positioned between a contracted BOAS position (FIG. 4) and an expanded BOAS position (FIG. 5) with respect to the full-hoop mount ring 70 by the puller 68. The puller 68 need only "pull" each associated air seal segment 64 as a differential pressure from the core airflow biases the air seal segment 64 toward the extended radially contracted BOAS position (FIG. 4). For example, the differential pressure may exert an about 1000 pound-force (4544 newtons) inward force on each air seal segment 64.

Figure 6:
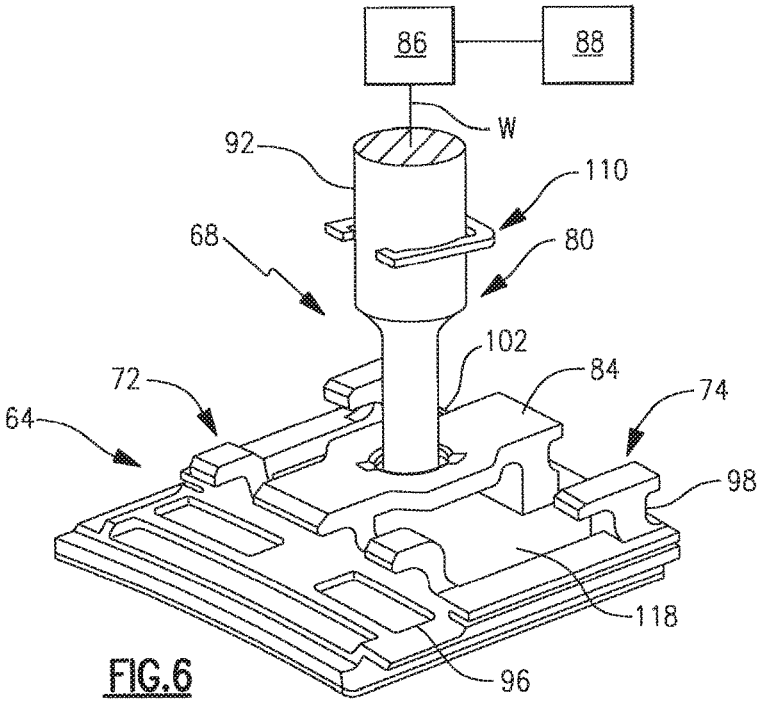
FIG. 6 is a partial perspective view of a puller for one air seal segment of the rapid response active clearance control system.

With reference to FIG. 6, the puller 68 generally includes a rod 80 with a multiple of lugs 82 (FIG. 7) that interfaces with a bridge hook 84 of each respective air seal segment 64. The rod 80 may extend to, or be a portion of, an actuator 86 (illustrated schematically) that operates in response to a control 88 (illustrated schematically). It should be appreciated that various other control components such as sensors, actuators and other subsystems may be utilized herewith.

The actuator 86 may include a mechanical, electrical and/or pneumatic drive that operates to move the respective air seal segment 64 along an axis W so as to contract and expand the radially adjustable blade outer air seal system 60. That is, the actuator 86 provides the motive force to pull the puller 68.

The control 88 generally includes a control module that executes radial tip clearance control logic to thereby control the radial tip clearance relative the rotating blade tips. The control module typically includes a processor, a memory, and an interface. The processor may be any type of known microprocessor having desired performance characteristics. The memory may be any computer readable medium which stores data and control algorithms such as logic as described herein. The interface facilitates communication with other components such as a thermocouple, and the actuator 86. In one non-limiting embodiment, the control module may be a portion of a flight control computer, a portion of a Full Authority Digital Engine Control (FADEC), a stand-alone unit or other system.

Figure 7:
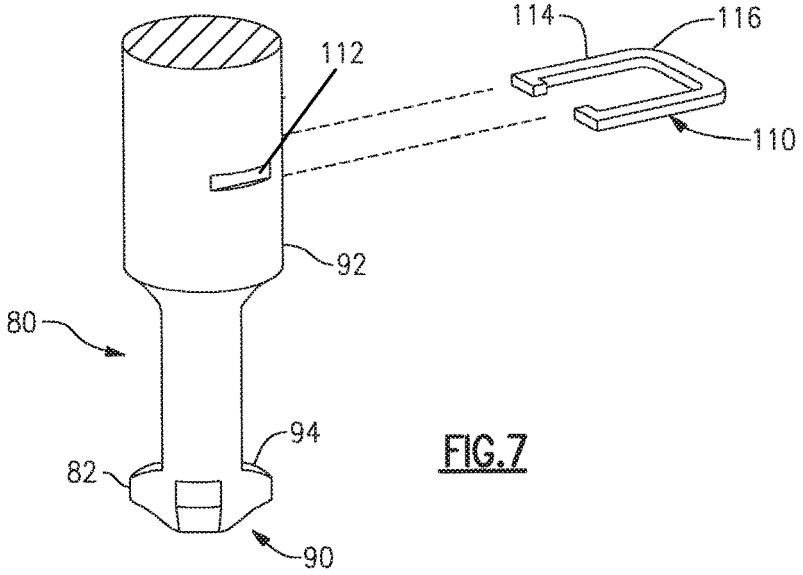
FIG. 7 is a partial perspective view of a puller rod.

With continued reference to FIG. 6, the multiple of lugs 82, in one disclosed non-limiting embodiment, includes three (3) equally spaced lugs about a distal end 90 of the rod 80 (FIG. 7). The multiple of lugs 82 define an outer diameter less than an outer diameter of an upper section 92 of the rod 80. The upper section of the rod 80 connects to, or forms a part of, the actuator 86 to facilitate a seal between the upper section 92 of the rod 80 and, for example, the engine case structure 36 and/or the full-hoop mount ring 70 (FIG. 2).

Figure 8:
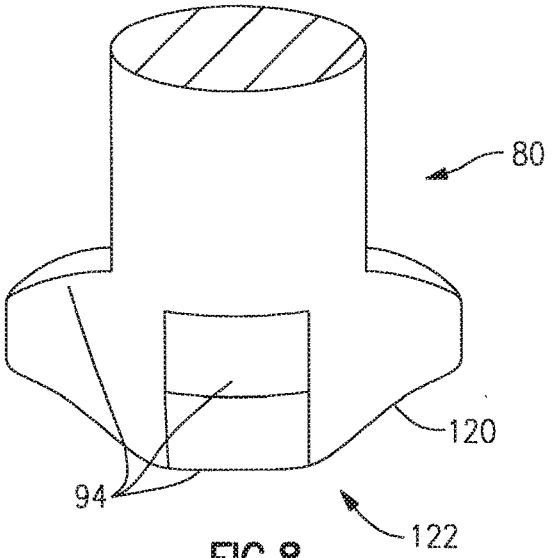
FIG. 8 is an expanded perspective view of a multiple of lugs on the rod of FIG. 7.

A lug engagement surface 94 on each of the multiple of lugs 82 may be of a semi-spherical profile (FIG. 8). That is, the multiple of lug engagement surfaces 94 defines a portion of a sphere. It should be appreciate that other lug engagement surfaces such as a frustro-conical surface may also be defined by the multiple of lugs 82.

Figure 9:
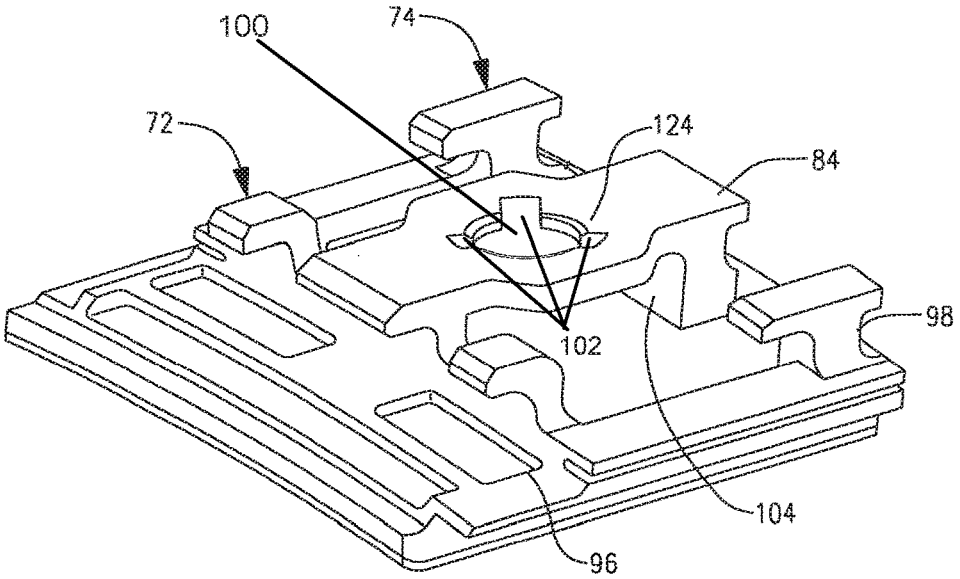
FIG. 9 is a generally cold side directed view of an air seal segment with a bridge hook.

The bridge hook 84 of each respective air seal segment 64 is located between the forward hook 72 and the aft hook 74. The bridge hook 84 bridges a forward rail 96 and an aft rail 98 from which the respective forward hook 72 and the aft hook 74 extend. The bridge hook 84 includes a lugged aperture 100 (FIG. 9) that corresponds with the multiple of lugs 82. That is, in the disclosed non-limiting embodiment, the lugged aperture 100 includes three (3) lug apertures 102 arranged to respectively receive the multiple of lugs 82.

The bridge hook 84 may be integrally formed with the air seal segment 64 or may be separately manufactured and welded thereto. The bridge hook 84 may also include a transverse split 104 through the lugged aperture 100 for stress relief.

The lugged aperture 100 includes an aperture engagement surface 106 (FIG. 10) that contacts the lug engagement surfaces 94 when the multiple of lugs 82 are inserted through the lug apertures 102 then rotated so that the aperture engagement surface 106 is in contact with the lug engagement surfaces 94. The rod 80 is then rotationally fixed by a clip 110 that engages a slot 112 in the upper section 92 of the rod 80 (FIG. 7). Flats 114 on the outer periphery 116 of the clip 110 rotationally fixes the clip 110 to the engine case structure 36 and thereby the rod 80. In one disclosed non-limiting embodiment, the rod 80 may be, for example, a piston rod of a pneumatic actuator system and the clip 110 may in alternative embodiments not be required as the pneumatic actuator system, for example, provides anti-rotation.

In one disclosed non-limiting embodiment, the aperture engagement surface 106 is frustro-conical. It should be appreciated that other aperture engagement surfaces such as a semi-spherical surfaces profiles may alternatively be provided. Since the aperture engagement surface 106 and the lug engagement surfaces 94 form a lugged contact interface that, in the disclosed non-limiting embodiment, is spherical to conical, a high degree of freedom is provided for the air seal segment 64. That is, the aperture engagement surface 106 (FIG. 10) and the lug engagement surfaces 94 (FIG. 8) essentially define a ball joint contact interface that provides significant freedom which will not overly constrain the RRACC system 58. Furthermore, as the bridge hook 84 and the multiple of lugs 82 are displaced from an inner surface 118 of the air seal segment 64, the interface has minimal—if any—effect upon the cooling scheme and cooling air passages 64P.

Figure 10:
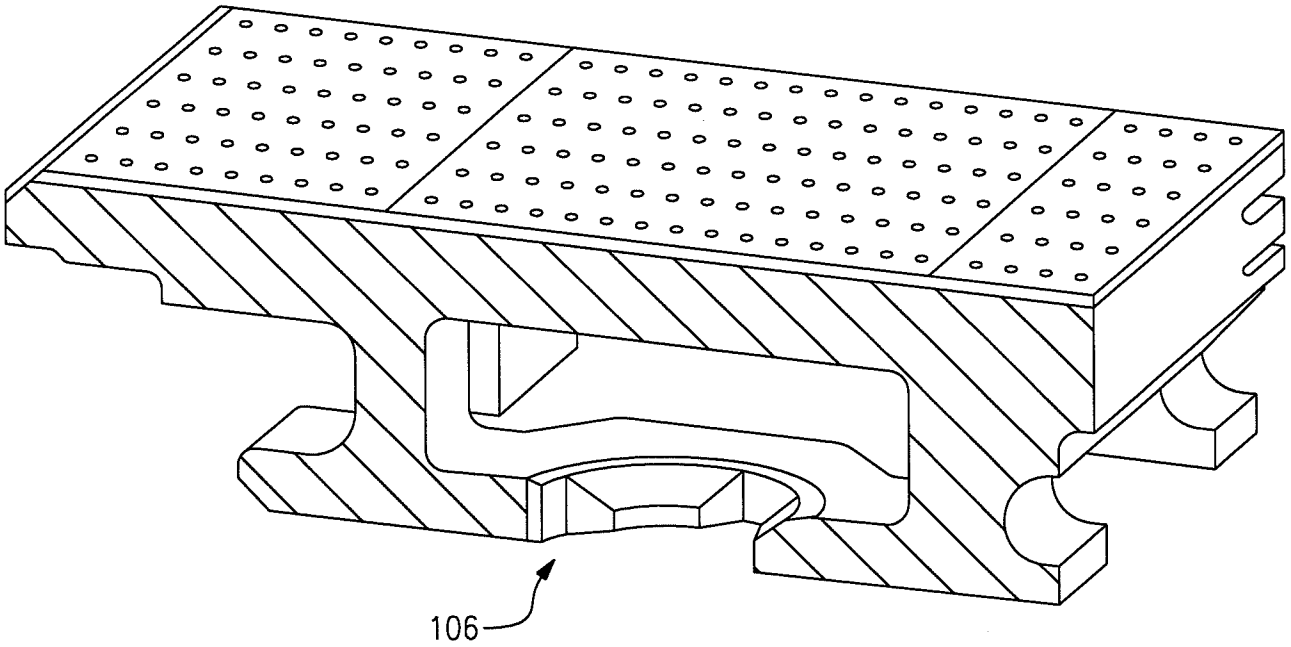
FIG. 10 is a generally hot side directed partial sectional view of the bridge hook to illustrate an aperture engagement surface for the lugs of the puller rod.

With continued reference to FIG. 6, to assembly each puller 68 to each respective air seal segment 64, the full-hoop mount ring 70 is assembled into the engine case structure 36 followed by the multiple of air seal segments 64. The rod 80 with the multiple of lugs 82 are inserted through the lug apertures 102 then rotated so that the aperture engagement surface 106 is in contact with the lug engagement surfaces 94. That is, once the multiple of lugs 82 are inserted through the lug apertures 102, the rod is indexed 60 degrees—for a three lug arrangement—so the lug engagement surfaces 94 (FIG. 8) contact the aperture engagement surface 106 (FIG. 10). A chamfer 120 on an insertion surface 122 of the multiple of lugs 82 (FIG. 8) and a chamfer 124 on the lugged aperture 100 (FIG. 9) facilitates blind assembly of the rod 80. The clip 110 then rotationally fixes the rod 80 with respect to the engine case structure 36.

The puller 68 of the RRACC system 58 provides thermal and aerodynamic isolation from the respective air seal segment 64 and permits significant freedom of movement with the ball joint interface.

The use of the terms "a" and "an" and "the" and similar references in the context of description (especially in the context of the following claims) are to be construed to cover both the singular and the plural, unless otherwise indicated herein or specifically contradicted by context. The modifier "about" used in connection with a quantity is inclusive of the stated value and has the meaning dictated by the context (e.g., it includes the degree of error associated with measurement of the particular quantity). All ranges disclosed herein are inclusive of the endpoints, and the endpoints are independently combinable with each other. It should be appreciated that relative positional terms such as "forward," "aft," "upper," "lower," "above," "below," and the like are with reference to the normal operational attitude of the vehicle and should not be considered otherwise limiting.

Although the different non-limiting embodiments have specific illustrated components, the embodiments of this invention are not limited to those particular combinations. It is possible to use some of the components or features from any of the non-limiting embodiments in combination with features or components from any of the other non-limiting embodiments.

It should be appreciated that like reference numerals identify corresponding or similar elements throughout the several drawings. It should also be appreciated that although a particular component arrangement is disclosed in the illustrated embodiment, other arrangements will benefit herefrom.

The foregoing description is exemplary rather than defined by the limitations within. Various non-limiting embodiments are disclosed herein, however, one of ordinary skill in the art would recognize that various modifications and variations in light of the above teachings will fall within the scope of the appended claims. It is therefore to be appreciated that within the scope of the appended claims, the disclosure may be practiced other than as specifically described. For that reason the appended claims should be studied to determine true scope and content.

What is claimed is:

1. An active clearance control system for a gas turbine engine comprising:

an air seal segment with a lugged aperture; and a puller with a multiple of circumferentially spaced lugs engageable with said lugged aperture, wherein the puller moves radially and radially moves said air seal segment, wherein said multiple of circumferentially spaced lugs each define a lug engagement surface engageable with a respective aperture engagement surface of said lugged aperture.

2. The system as recited in claim 1, further comprising a bridge hook that includes said lugged aperture.

3. The system as recited in claim 2, further comprising a forward hook and an aft hook that extends from said air seal segment, said bridge hook between said forward hook and said aft hook.

4. The system as recited in claim 1, wherein said lugged aperture includes three (3) lugged apertures.

5. The system as recited in claim 1, wherein said lugged aperture includes a transverse split through said lugged aperture.

6. The system as recited in claim 1, wherein said lug engagement surface defines a semi-spherical profile.

7. The system as recited in claim 6, wherein said aperture engagement surfaces define a frustro-conical profile.

8. The system as recited in claim 1, wherein said aperture engagement surfaces define a frustro-conical profile.

9. The system as recited in claim 1, further comprising a chamfer on an insertion surface of said multiple of circumferentially spaced lugs and a chamfer on said lugged aperture opposite said aperture engagement surfaces.

10. An active clearance control system of a gas turbine engine comprising:

an air seal segment with a bridge hook having a lugged aperture; and a puller with a multiple of circumferentially spaced lugs engageable with said lugged aperture, wherein the puller moves radially and radially moves said air seal segment, wherein said multiple of circumferentially spaced lugs each define a lug engagement surface engageable with a respective aperture engagement surface of said lugged aperture.

11. The system as recited in claim 10, further comprising a forward hook and an aft hook that extends from said air seal segment, said bridge hook between said forward hook and said aft hook.

12. The system as recited in claim 11, wherein said lugged aperture includes three (3) lugged apertures.

13. A method of active blade tip clearance control for a gas turbine engine, comprising:

engaging a puller that includes a multiple of circumferentially spaced lugs with an air seal segment that includes a lugged aperture, wherein the puller moves radially and radially moves the air seal segment and said multiple of circumferentially spaced lugs each define a lug engagement surface engageable with a respective aperture engagement surface of said lugged aperture, inserting said multiple of circumferentially spaced lugs that extend from the puller into the lugged aperture; and rotating the puller to obtain a lugged contact interface that allows the air seal segment to move radially in response to radial movement of the puller.

14. The method as recited in claim 13, wherein the aperture engagement surfaces include a spherical interface.

15. The method as recited in claim 13, wherein the aperture engagement surfaces include a frustro-conical interface.

16. The method as recited in claim 13, wherein the aperture engagement surfaces include a spherical-to-conical interface.

17. The method as recited in claim 13, further comprising rotationally fixing the puller at the aperture engagement surface.

* * * * *